US005458062A

United States Patent [19]

Goldberg et al.

[11] Patent Number: 5,458,062

[45] Date of Patent: Oct. 17, 1995

[54] CONTINUOUS WEB PRINTING PRESS WITH PAGE CUTTING CONTROL APPARATUS AND METHOD

[76] Inventors: Ira B. Goldberg, 54 Westbury Ct., Thousand Oaks, Calif. 91360; Edward Hudyma, 631 Derbyshire La., Bolingbrook, Ill. 60440; Ragy A. Isaac, 895 Brampton Cir., Bolingbrook, Ill. 60440; Kenneth W. Dabisch, 216 Flaggstaff Dr., Bolingbrook, Ill. 60440

[21] Appl. No.: 203,261

[22] Filed: Feb. 28, 1994

[51] Int. Cl.[6] ..... B41F 27/00

[52] U.S. Cl. ..... 101/485; 101/226; 101/227

[58] Field of Search ..... 101/216, 219, 101/226, 223, 491, 483, 484, 485, 181, 470, 227

[56] References Cited

U.S. PATENT DOCUMENTS

| | | | |
|---|---|---|---|
| 3,237,973 | 3/1966 | Rumberger | 101/485 |
| 3,827,355 | 8/1974 | Hamisch, Sr. | 101/226 |
| 4,067,760 | 1/1978 | Nelson | 101/181 |
| 4,294,637 | 10/1981 | Rump | 101/470 |
| 4,296,176 | 10/1981 | Lennon et al. | 101/491 |
| 4,719,855 | 1/1988 | Cannon et al. | 101/485 |
| 4,898,094 | 2/1990 | Doumoto et al. | 101/485 |
| 5,134,932 | 8/1992 | Fujiwo | 101/484 |
| 5,178,063 | 1/1993 | Wolfberg et al. | 101/226 |
| 5,289,770 | 3/1994 | Hern | 101/226 |

*Primary Examiner*—Eugene H. Eickholt

[57] ABSTRACT

A printing press with a page cutting control apparatus (11) for controlling cut-off registration in a rotary printing press (10) includes markers (30, 32, 51, 53) for printing reference marks (36) on webs (20, 23) with magnetizable ink having magnetic particles therein, magnetizers (62, 64, 65, 67) for magnetizing the reference marks, sensors (121–124) for magnetically detecting the reference marks, and a controller (140) for changing the web length in response to the detecting.

31 Claims, 6 Drawing Sheets

CONTINUOUS WEB PRINTING PRESS WITH PAGE CUTTING CONTROL APPARATUS AND METHOD

BACKGROUND OF THE INVENTION

1. Field of the Invention

This invention generally relates to a continuous web printing press and specifically such continuous web printing presses with page cutting apparatus.

2. Description of the Related Art Including Information Disclosed Under 37 C.F.R 1.97–1.99

Continuous web printing presses, such as high speed, high volume rotary presses such as used to print newspapers and the like, generally have a plurality of paper webs. These plurality of webs from a plurality of separate printing units are sent via separate paths to a single folding/cutting mechanism. Each printing unit has at least one plate cylinder and at least one blanket cylinder for printing on the web. Each printing unit also has numerous other running cylinders and rollers for threading the web through the printing unit and to the folding/cutting mechanism for cutting into detached pages. It is necessary that the cutter of the folding/cutting mechanism cut the webs at the imaginary page boundary lines between the adjacent pages as printed on the web. In known rotary printing presses, the cutter is stationary with respect to the cylinders that print the image on each web, and proper cut-off registration is achieved by adjusting each web path length. It is well known for press operators to manually adjust the web path length based upon their visual observation of the cut paper product as it comes out of the folding/cutting mechanism. It is also well known that once the web path adjuster is set for a given cut-off registration, there are other variables which can cause improper registration which must be corrected by resetting the web path adjuster. A change in press speed generally requires an adjustment to maintain proper cut-off registration. In addition, a change in paper is known to require an adjustment due to a change in moisture content or elasticity of the paper.

Apparatus for achieving proper page cutting registration are also well known. These methods use photosensors that detect the location of printed pages on the webs by optically detecting either the edges of the normal printing array or by detecting special reference marks printed on the page using the same ink as is used to print the printed body of the page. An example of a control apparatus that optically detects the printed body of the page is described in U.S. Pat. No. 4,896,605 issued Jan. 30, 1990 to Schroder. A disadvantage of this method is that the printing press must print the entire printed body of the page before detection and registration can be obtained. In addition, optical detection of printing requires that the printing be clear. Other known methods merely maintain, but cannot initially establish, cut-off registration as shown in U.S. patent application Ser. No. 787,491 filed on Nov. 4, 1991 of Hudyma et al. Disadvantageously, pages printed by a rotary printing press immediately after it starts, or during starting, are not sufficiently clear to enable reliable photoptical detection. Accordingly, these methods that depend upon optically detecting the normal printed body of the page image or detecting special reference marks printed by the same means used in normal printing are unable to achieve proper registration quickly. Accordingly, there is a wastage of ink, paper and other resources as well as a disposal problem due to production of improperly cut pages.

Examples of devices in which reference marks are printed on the web by means separate from the main printing mechanism are shown in U.S. Pat. No. 5,088,403 issued Feb. 18, 1992 to Shoji and U.S. Pat. No. 5,119,725 issued Jun. 9, 1992 to Okamura. However, poor printing quality of the newspaper image such as occurs when a press is starting can obliterate the independently printed reference marks, thereby delaying the determination of proper cut-off registration.

Furthermore, these methods suffer from other disadvantages. The presence of ink, dirt, dust or oil in a printing press environment are common and can significantly interfere with the ability of the photosensors to operate properly and these devices therefore require frequent cleaning. Precise alignment between the relatively small reference mark and the sensor is necessary for proper detection but difficult to obtain and to maintain during press operation. This alignment problem is partially difficult to solve due to sideways web drift which is inherent in rotary printing presses. In addition, known methods which use separate devices to print reference marks disadvantageously require complicated blanket cylinder phase detection device to print the reference marks in phase with the blanket cylinder which are prone to failure if not properly installed and maintained.

Another disadvantage of known optical or photoelectric based page cut controllers is that a separate sensor is required for each web since the opacity of the paper makes it impossible to detect marks on one web through the body of another web or through the body of the one web.

With known page cutting controllers, it is not possible to place a plurality of sensors in close proximity to the folding/cutting mechanism due to a lack of space between the webs at the entry point to the folding/cutting mechanism. Specifically, it has not been possible to place a plurality of sensors as close as one page length away from the cut. The most accurate determination of registration is achieved when the sensors are placed as close as possible to the cutter, so the inability to place a plurality of sensors near the folding/cutting mechanism significantly detracts from accuracy.

BRIEF DESCRIPTION OF THE DRAWINGS

The foregoing objects and advantageous features of the invention will be explained in greater detail and others will be made apparent from the detailed description of the preferred embodiment of the present invention which is given with reference to the several figures of the drawing, in which.

SUMMARY OF THE INVENTION

It is therefore the principal object to the present invention to provide a continuous web printing press which overcomes the disadvantages of known printing presses and methods for detecting reference marks independently of visible light.

This object is achieved by provision of a method of controlling the relative location of page cuts in a continuous web printing press, comprising the steps of (1) placing reference marks on a web, (2) detecting the reference marks independently of visible light from the reference mark and (3) controlling the relative position of page cuts to the web in accordance with the light independent detecting of the reference marks.

The object is also achieved by providing a continuous web printing press having a cutting mechanism for making page cuts on the web, with a page cutting control apparatus comprising means for placing reference marks on the web, means for detecting the reference marks independently of visible light from the reference marks and means for controlling the relative position of page cuts to the web in response to the light independent detecting means.

DESCRIPTION OF THE PREFERRED EMBODIMENT

Figure 1A:
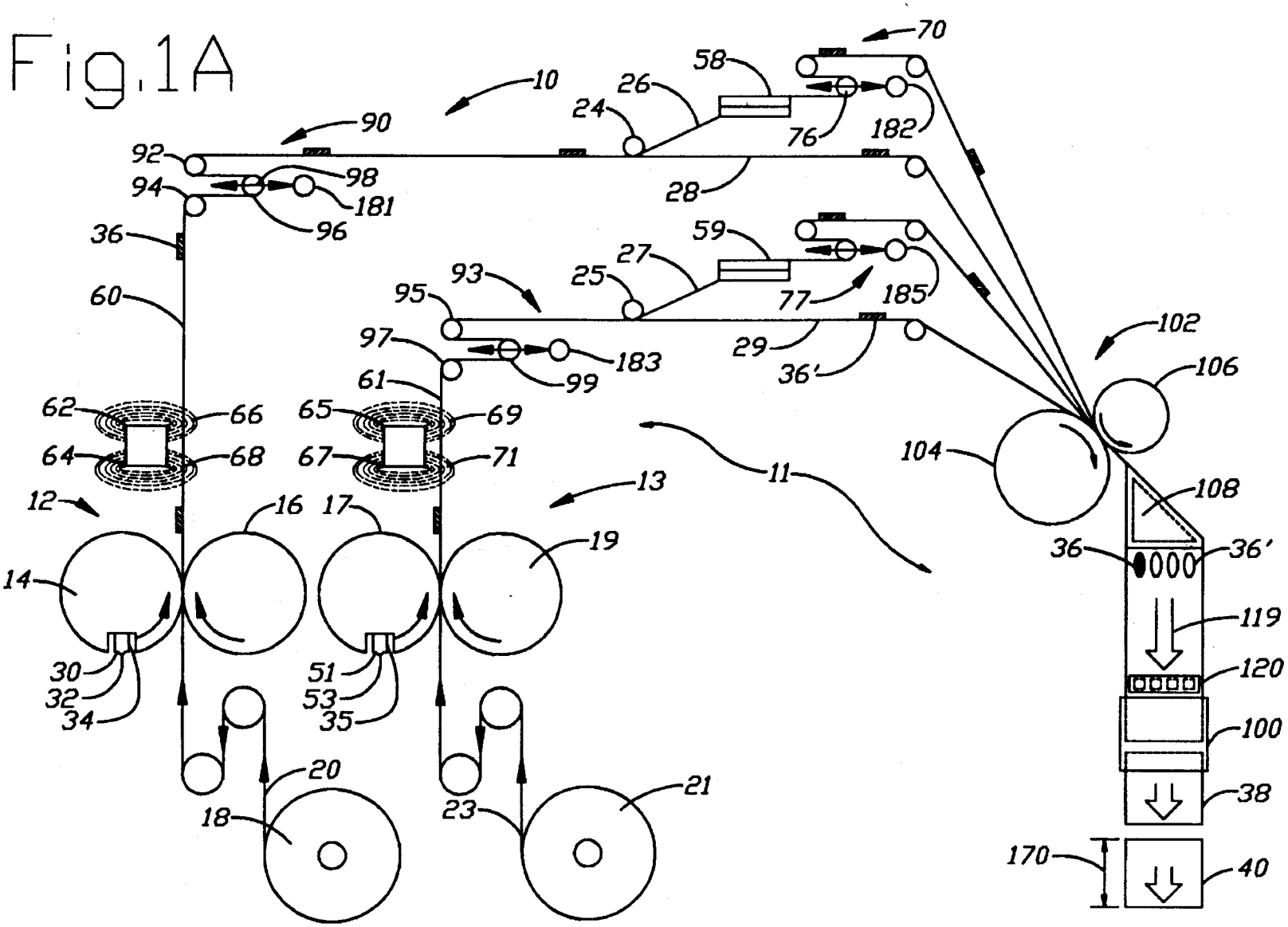
FIG. 1A is a simplified diagrammatic representation of a printing press with two, double-width printing units provided with a preferred embodiment of the page cutting apparatus of the present invention with four marking units and magnetizers and a magnetic sensor array.
Figure 1B:
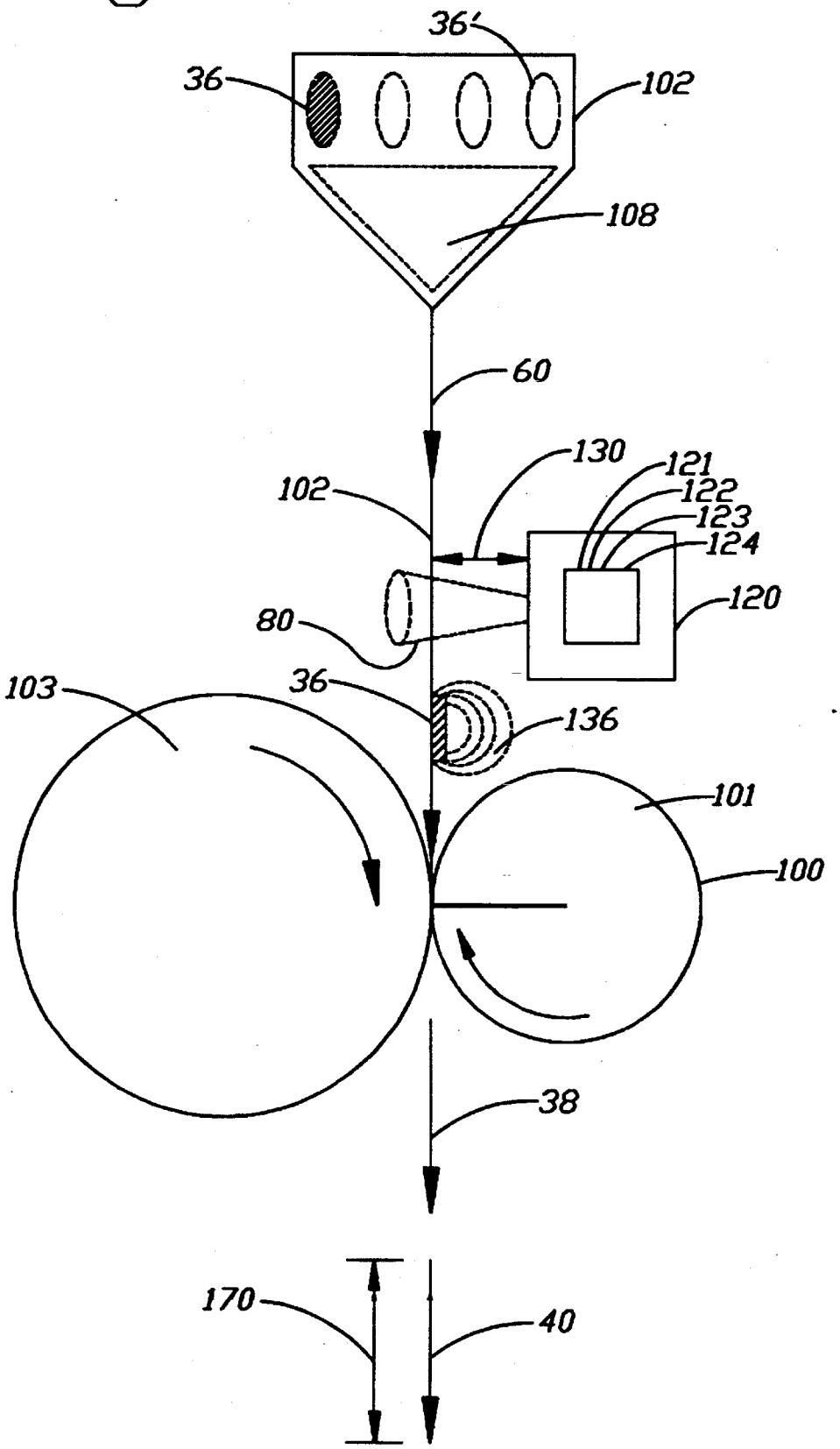
FIG. 1B is a schematic side view of a portion of FIG. 1A showing the sensor array, the folding/cutting mechanism and multiple webs entering the folding/cutting mechanism.

Referring now to FIGS. 1A and 1B, a preferred embodiment of the continuous web printing press 10 with the page cutting control apparatus 11. Press 10 is a high speed rotary press, such as used to print newspapers, and includes two substantially identical double-width printing units 12 and 13. Referring to printing unit 12, a double-width paper roll 18 is provided for supplying a double-width paper web 20 to the blanket cylinders 14 and 16. The double-width paper web 20 is longitudinally slit down its center by a slitter 24 to form two single-width webs 26 and 28. Thereafter, web 26 goes through a turning device 58.

Figure 2B:
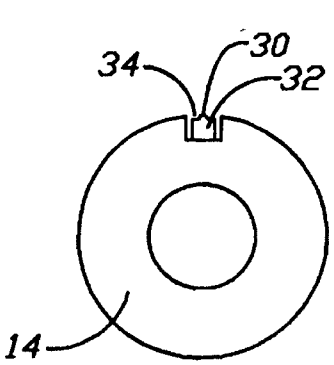
FIG. 2B is a simplified side view of a blanket cylinder of the other printing unit shown in FIG. 1A showing two other marking units mounted within a longitudinal slot for rotation with the blanket cylinder of the printing unit.
Figure 2A:
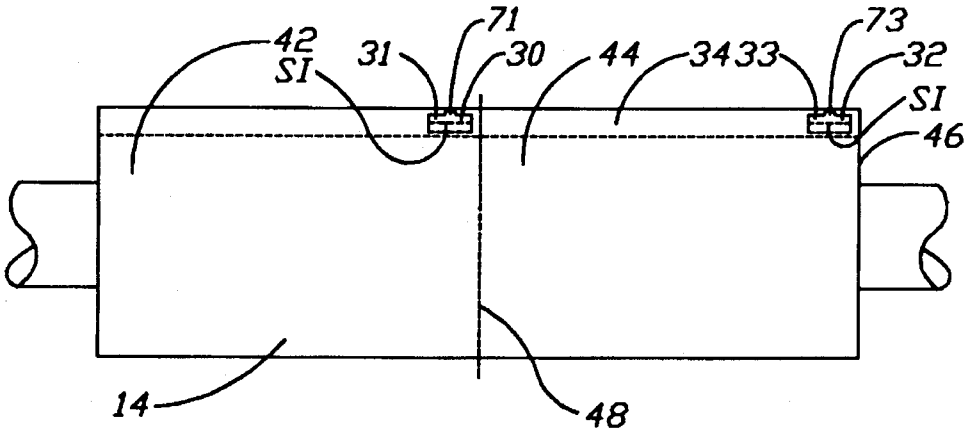
FIG. 2A is a simplified side view of a blanket cylinder of one of the printing units shown in FIG. 1A showing two marking units mounted within a longitudinal slot for rotation with the blanket cylinder.
Figure 2D:
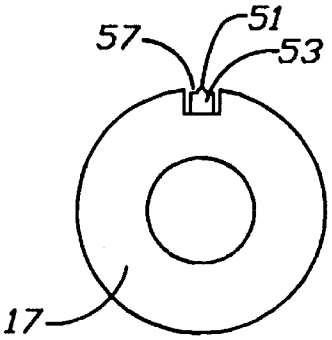
FIGS. 2C and 2D are simplified end views of the blanket cylinders shown in FIGS. 2A and 2B, respectively.
Figure 2C:
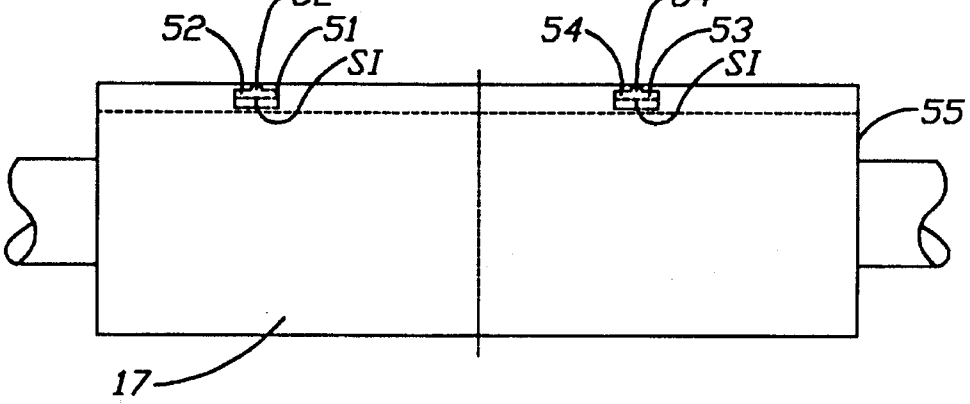

As shown in FIG. 2A, two markers 30 and 32 are mounted within a longitudinal slot 34 in blanket cylinder 14 of printing unit 12. Each marker 30 and 32 places or prints a reference mark 36 on the web 20 for indicating where the web will be cut to produce detached pages 38 and 40. In accordance with the invention, these marks are detectable by sensors which operate independently of visible light. Each marker 30 and 32 is mounted within one of the two longitudinal halves 42 and 44 of the blanket cylinder 14 to ensure that a reference mark 36 is placed on each single-width web 26 and 28 after slitting.

The relative axial locations of the markers 30 and 32 within the blanket cylinder 14 of printing unit 12 are different from the relative axial locations of the markers 51 and 53 within the blanket cylinder 17 of printing unit 13. As shown in FIG. 2A, the markers 30 and 32 of blanket cylinder 14 are mounted near an edge 46 and near the center 48 of the blanket cylinder 14, respectively. As shown in FIG. 2B, the markers 51 and 53 of blanket cylinder 17, on the other hand, are mounted at locations approximately three-quarters and one-quarter of the length of the blanket cylinder from an edge 55 of the blanket cylinder 17. As a result, the reference marks 36 on each of the four single-width webs 26, 27, 28 and 29 are at different relative locations on each single-width web.

The markers 30, 32, 51 and 53 place or print relatively small reference marks 36 on double-width paper webs 20 and 23 between printed pages (not shown) at regular intervals, generally at every eight to twenty printed pages. Preferably, each reference mark is about one-half inch long by about one-eighth inch wide with no significant height; however, the reference marks are shown greatly exaggerated in size in the drawing for purposes of illustration. Each marker 30, 32, 51 and 53 includes a marking device 31, 33, 52 and 54, respectively, for to print or otherwise place reference marks 36 on one of the webs 20 and 23, and a reservoir 71, 73, 82 and 84, respectively, for holding a quantity of special reference mark ink SI. Preferably, the marking device 31, 33, 52 and 54 sprays a jet of the special reference mark ink onto the web to form the mark 36.

Although the markers 30, 32, 51 and 53 are mounted to, and rotate with, the blanket cylinders 14 and 17, the markers place reference marks 36 on the paper webs 20 and 23 independently of printing by the blanket cylinders 14, 15, 16, and 17 of the printing press 10. Unlike known markers, the invention does not require complicated phasing devices to coordinate the printing of the reference marks 36 with the printing of the pages of the newspaper or other printed product, because the markers 30, 32, 51 and 53 of the invention 10 are mounted to, and rotate with, the blanket cylinders 14 and 17. Markers 30 and 32 put a series of reference marks 36 on a same relative side 60 of the web 20 as the other markers 51 and 53 put on web 23.

The special ink SI used for printing the reference marks 36 preferably contains ferrite particles capable of being magnetized. Preferably, the particles will not be magnetized until after the reference marks 36 are placed on the webs 20 and 23 by the markers 30, 32, 51 and 53. The ink SI is preferably an offset magnetic ink, K-200, manufactured by Flint Ink of Flint, Michigan having 30% by weight magnetite. Alternatively, a mixture of a water based, high remanence, low coercity, low viscosity ink having no volatile organic materials and having 30–80% by weight magnetic material is used. The ink mixture is at least 30% magnetic material in order to produce a magnetic field sufficiently strong to be detectable by the magnetic sensors without the reference marks being so large as to interfere with, or distract attention away from, the printed product. On the other hand, the necessity for sufficient fluidic media for suspension of the magnetic particles and the necessity for adhesive compounds tends to limit the maximum percentage of magnetic particles to 80%. The ink is further composed of water, 57% or less, sodium tripolyphosphate, approximately 1%, surfactants, approximately 2% and nonmagnetic solids, 10% or less. Preferably, the magnetic material is magnetite having an acicular particle shape, a length of approximately one micrometer and an aspect ratio of approximately 6:1 to 15:1, and barium ferrite having a platelet particle shape with a cross section length of approximately 0.4 to 1.0 micrometer and a thickness of less than 0.1 micrometer.

Magnetizers 62 and 64 of printing unit 12 shown in FIG. 1A are located downstream from the blanket cylinder 14 and from the markers 30 and 32. Although the magnetizers 62 and 64 shown in FIG. 1A are mounted to the printing press 10 on the same side 60 of the web 20 as the side 60 having the reference marks 36, alternatively the magnetizers 62 and 64 are mounted on the opposite side without affecting their efficacy.

The magnetizers 62 and 64 are mounted such that the web 20 passes through magnetic fields 66 and 68 generated by the magnetizers. After passing through one of the magnetic fields 66 and 68, the reference marks become magnetized and, for a period of time, each reference mark produces its own magnetic field. Each magnetizer 62 and 64 is preferably a permanent magnet.

In the preferred embodiment 10 of FIG. 1A, each magnetizer 62 and 64 is a Neodymium Iron Boron permanent magnet with a flux density of 10,500 to 12,000 gauss at the poles. Alternatively, an electromagnet that generates sufficient flux density to magnetize the ferrite particles in the reference mark ink is used. Each magnetizer 62 and 64 magnetizes the reference marks 36 printed by one of the marking units 30 and 32, respectively. Alternatively, one larger magnetizer (not shown) is used to generate a larger magnetic field (not shown) encompassing the entire web of printing unit 12. The location of the magnetizers 62 and 64 shown in FIG. 1A is not critical to the proper operation of the invention 10 except that the magnetic fields 66 and 68 generated by the magnetizers 62 and 64 should not intersect fields of detection 80 of magnetic sensors 121–124. In addition, in order to limit the number of magnetizers required, the magnetizers 62 and 64 are located upstream from the slitter 24. Alternatively, if premagnetized ink is used for the reference marks, then no magnetizers are required.

As shown in FIG. 1A, the web 20 of printing unit 12 is threaded through a web path length compensator, or adjuster, 90. The web path length compensator 90 has a pair of idler rollers 92 and 94 and a compensator roller 96. The compensator roller 96 is movable as indicated by arrow 98 towards and away from the idler rollers 92 and 94 in order to decrease and increase, respectively, the length of the path of single-width web 28 between the blanket cylinders 14 and 16 and a folding/cutting mechanism 100. Web length compensator 70 controls the length of single-width web 26 in a similar manner. Servomotors 181 and 182 move the compensator rollers 76 and 96 in response to signals from a web length controller 140, FIG. 4. The markers 51 and 53, magnetizers 65 and 67 and web length compensators 93 and 77 of printing unit 13 operate in substantially the same manner as the corresponding components of printing unit 12.

Figure 3:
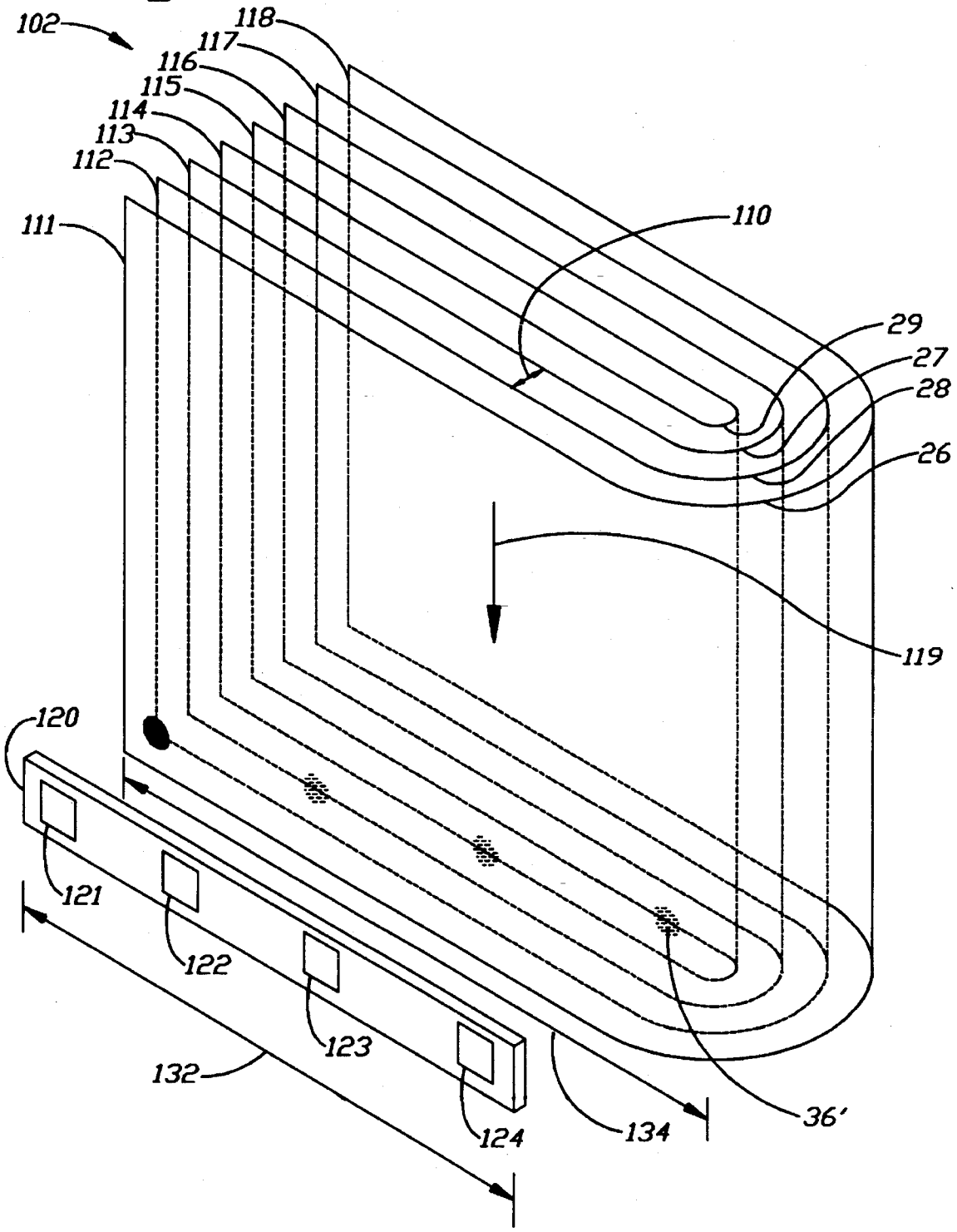
FIG. 3 is a simplified diagrammatic illustration of the spatial relationship between the magnetic sensor array and reference marks on four folded webs prior to entering the folding/cutting mechanism.

The four single-width webs 26, 27, 28 and 29 produced by the two printing units 12 and 13 are threaded together as a group 102 between a roller 104 and a trolley 106. The group 102 of four webs 26, 27, 28 and 29 is passed over a wedge-like former board 108 shown in FIGS. 1A and 1B which folds the group 102 along its longitudinal midline. As shown in FIG. 3 the folded group 102 of four webs 26, 27, 28 and 29 enters the folding/cutting mechanism 100 as eight layers of paper 111–118 moving in the direction indicated by arrow 119. An array 120 of sensors 121–124 is mounted to the printing press proximate to the group 102. The distance 110 between the eight layers of paper 111–118 shown in FIG. 3 is exaggerated for illustrative purpose. In fact, the layers 111–118 are so close together to make it impossible to mount an individual sensors 121–124 between pages 112–115 having reference marks 36.

As shown in FIGS. 1A and 1B, a sensor array 120 is mounted to the printing press at a location upstream from the folding/cutting mechanism 100 and relatively close to the surface 60 of the group 102 of webs 26, 27, 28 and 29. The distance 130 between the sensor array 102 and the group of webs 26, 27, 28 and 29 shown in FIG. 1B is exaggerated in order to show the field of detection 80 of the sensors 121–124. The sensor array 120 detects the presence of reference marks 36 on the outer web 26 of the group 102 as well as the reference marks 36 on the inner webs 27, 28 and 29. Unlike the known prior art, the sensor array 120 detects reference marks 36 on inner webs 27, 28 and 29 at a location only one page length upstream from the line where a cutting cylinder 101, in cooperation with a folding cylinder 103, cuts the webs. The sensor array 120 is preferably mounted to the printing press 10 on the same sides 60 and 61 of the webs 20 and 23 as the sides 60 and 61 having the reference marks 36; however, alternatively, the array 120 is mounted on the side opposite the reference marks with only a slight loss of efficacy.

Referring again to FIG. 3, the sensor array has a width 132 of approximately the width 134 of the folded group 102 and is comprised of four sensors 121, 122, 123 and 124 evenly spaced in the array such that one reference mark 36 passes through the field of detection 80 of each sensor. Each sensor 121–124 of the array 120 is one of a Hall Effect sensor 152, an inductive loop sensor (not shown) and a superconducting quantum interference detector (not shown), all of which are well known magnetic field sensors. Alternatively, each sensor 121–124 is one of a fluxgate magnetometer, and a magnetoresistive element. In the embodiment of FIG. 1A, each sensor is preferably a Model GH-601 Hall Effect generator manufactured by F. W. Bell, Inc. of Orlando, Fla. or a Model SS94A1F analog position sensor manufactured by Honeywell Microswitch of Freeport, Ill. The operation of a Hall effect sensor 152 is well known to those skilled in the art.

Importantly, the magnetic field 136 caused by a magnetized reference mark 36' on the inner-most web 29 is sufficiently strong to penetrate the outer webs 26, 27 and 28 to be detectable by one of the magnetic sensors 124. Thereby, the sensors 122, 123 and 124 for the inner webs 27, 28 and 29 of the group 102 are located externally to the group 102. As a result, it is possible to locate the sensors 122–124 for the inner webs 27–29 very closely to the entrance to the folding/cutting mechanism 100. It has been determined to be advantageous to locate the array 120 as close as possible to the folding/cutting mechanism 100. It has been determined that when this is done the determination of the location of the reference marks 36 most accurately determines the location of the cut.

Figure 4:
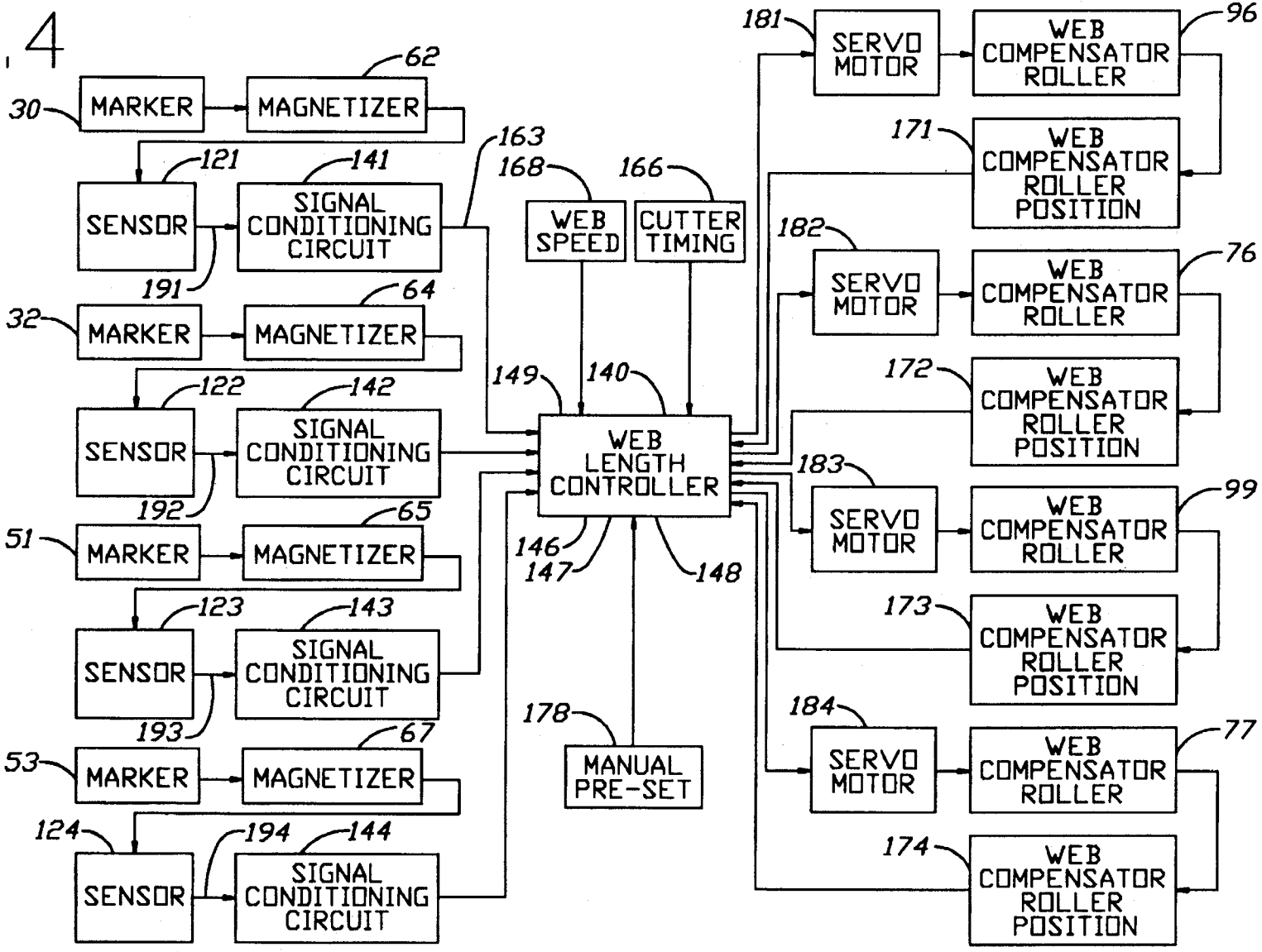
FIG. 4 is a simplified diagram of the preferred embodiment of the page cutting control apparatus of the present invention.

As shown in FIG. 4, the output 191–194 of each sensor 121–124 is electrically coupled to a signal conditioning circuit 141–144. Each signal conditioning circuit 141–144 is substantially identical to the signal conditioning circuit 141 shown in FIG. 5. The output 191 from the integrated Hall Effect generator and amplifier 152 is coupled through an active high pass filter 154 and its output 155 is electrically coupled to an active low pass filter 156. An output 157 of the active low pass filter 156 is coupled to a voltage comparator 158 which compares it to a reference potential. If the input signal exceeds the reference potential, a pulse from the output of the voltage comparator 159 shaped by a one-shot pulse circuit 160 which produces a square wave signal. The square wave signal produced on the output 161 of the one-shot pulse circuit is electrically coupled to a digital correlator 162 which cross-correlates the output 161 of the one-shot pulse circuit with a reference waveform. The output 163 of the digital correlator which provides an opposite feedback signal to the web length controller 140.

The signal conditioning circuits are tuned to an expected frequency associated with the movement of the reference marks 36 through the field of detection 80 of the sensors 121–124. For a given field of detection 80, the frequency is a function of the length of the reference mark 36 measured in the direction of web motion and the speed of the webs 26–29.

Figure 5:
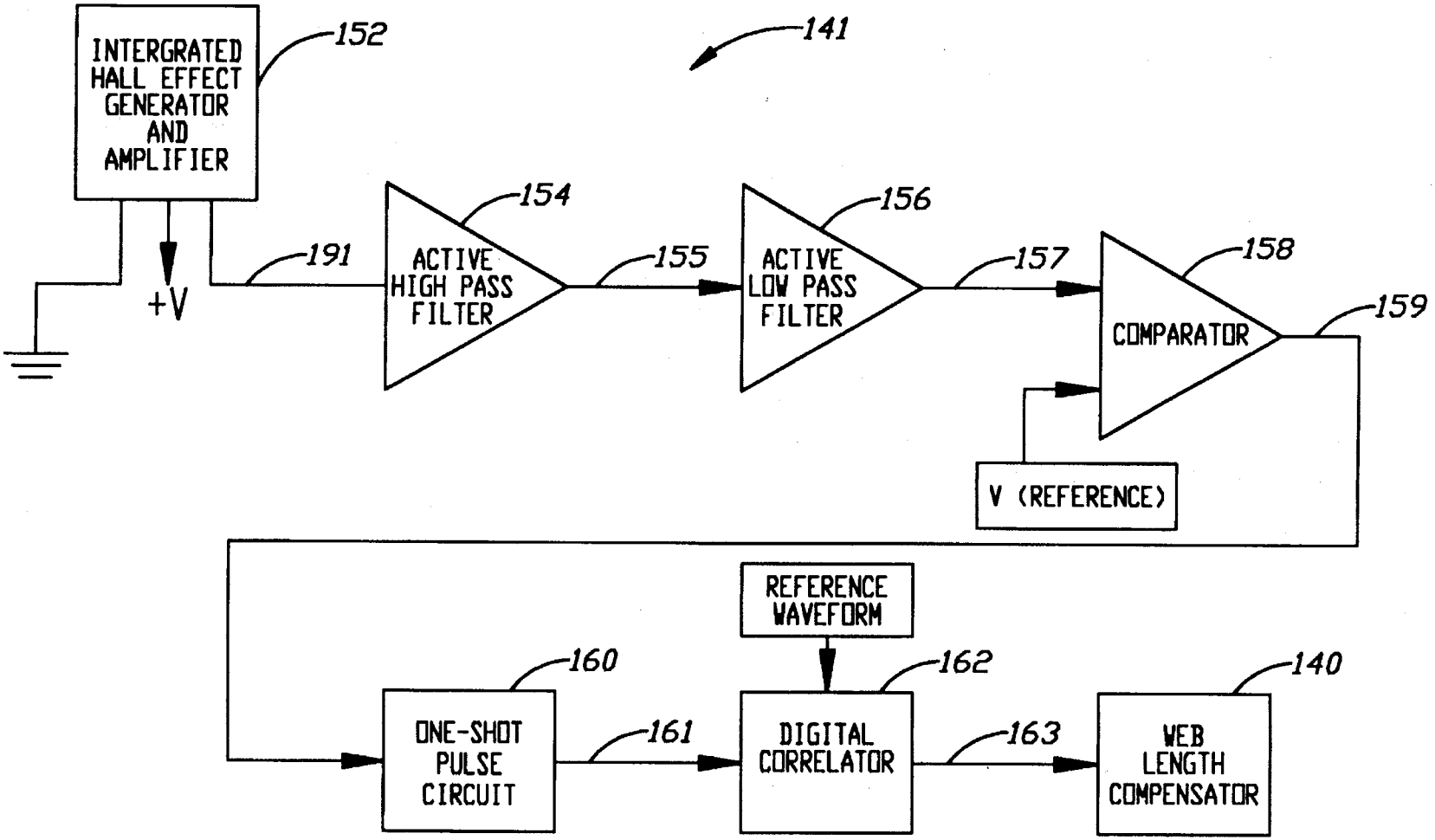
FIG. 5 is a simplified block diagram of one of the signal conditioning circuits of FIG. 4.

Preferably, the signal conditioning circuit 141 shown in FIG. 5 is used. Alternatively, a circuit using an analog correlator (not shown) in conjunction with a general purpose microprocessor-based digital computer (not shown) is substituted for the digital correlator 162. In addition, the circuit of FIG. 5 is alternatively enhanced by modulating an input current to the Hall Effect sensor by a frequency at least four times the highest frequency associated with the reference marks 36 and then demodulating the output 191 of the sensor 121 by a phase sensitive detection circuit in phase with the input current modulation. The details of the operation of such a signal conditioning circuit described above and shown in FIG. 5 are well known to those skilled in the art and form no part of the present invention.

Referring again to FIG. 4, the output 191–194 of each signal conditioning circuit 141–144 is electrically coupled to the web length controller 140. The web length controller 140 has a microprocessor 146, a random access memory 147, a read only memory 148 and a clock 149. Preferably, the feedback between the sensors 121–124 and the web path length compensators 70, 77, 90 and 93, operates from start-up to obtain cut-off registration. Alternatively, the cut-off registration is manually set by a known preset adjustment mechanism 178, and the invention maintains the cut-off registration as described hereinafter.

The expected times a reference mark 36 is expected to be detected by a sensor 121–124, for a given speed of the printing press 10, are stored in memory of the web length controller 140. Also stored in memory, for each web 26–29, is an expected shape of a curve of the magnitude of the sensor output 191–194 versus the position of the reference mark 36 relative to the sensor 121–124. The digital correlator 162 shown in FIG. 5 cross-correlates the expected shape with an actual shape of the curve of the magnitude of the sensor output 191–194 versus the position of the reference mark 36 relative to the sensor 121–124. For some simplicity in operation, the sensor array 120 is located substantially one page length 170 away from where the cut is made; therefore, when cut-off registration is properly established, the sensors 121–124 of the array 120 detect the reference marks 36 of a page 38 at substantially the same time as the cutter cuts an adjacent page 40. Alternatively, the sensor array 120 is located any distance away including a nonintegral number of page lengths or less than a page length away from the cut.

As shown in FIG. 4, cutter timing data 166, web speed data 168 and the position of the compensators 171–174 are supplied to the web length controller 140. No web length adjustment is made if the time that a sensor 121–124 detects a reference mark 36 coincides with the stored expected time. However, for each web for which a sensor 121–124 detects a reference mark 36 at a time earlier than the expected time, the controller 140 sends a signal to one of the servomotors 181–184 to increase the web length of that web. The amount of increase in web length is dependent upon press speed and, of course, the amount of the time difference. In a similar manner, the web length controller 140 sends a signal to one of the servomotors 181–184 to decrease the length of that web when the reference marks on that web are detected after the expected time. The web length controller 140 and web length compensators 76, 77, 90 and 93 operate in a manner similar to the central processing unit and compensator rollers, respectively, described in U.S. application, Ser. No. 787,491 filed Nov. 4, 1991 by Hudyma et al., except in Hudyma et al. the web length is adjusted in response to different input parameters. Although it is preferable that the controller controls the web length, alternatively, the controller controls one or more of web length, web tension, web speed, cutter position and cutter timing in a manner dictated by continuity of web mass flow through a press.

The preferred method of controlling the relative location of page cuts in a continuous web printing press 10 includes the steps of placing reference marks 36 on the double-width webs 20 and 23 by markers 30, 32, 51 and 53 mounted to blanket cylinders 14 and 17. The method also includes the step of detecting the reference marks 36 by magnetic sensors 121–124. The method further includes the steps of controlling the relative position of page cuts to single-width webs 26–29 by operating a web length adjuster 140 in response to the time of detection of the reference marks 36 to individually, selectively increase and decrease the path of each web to position each web for cutting into detached pages, such as pages 38 and 40, by a cutting/folding mechanism 100.

While a detailed description of the preferred embodiment of the invention has been given, it should be appreciated that many variations can be made thereto without departing from the scope of the invention as set forth in the appended claims. For example, in some known printing presses, the single-width web is again longitudinally slit (not shown) in which case four marking units (not shown) are mounted to the blanket cylinder. In addition, other alternative reference marks such as a metallic marker, changing the temperature of a portion of the web or making a hole in a portion of the web are used. Further, other alternative sensors, also independent of visible light, are used such as an infrared light sensor, an ultraviolet light sensor, a thermal sensor, an acoustic sensor, a capacitive sensor, a tactile sensor or other proximity sensors. Alternatively, microwaves or other electromagnetic energy is transmitted toward a web and reflected energy is received by a radio sensor. Other methods of controlling the relative position of the page cut-off include methods of changing at least one of web velocity and web tension at various points along the web path with the manipulation of these factors being consistent with the continuity of mass flow of the web through the press. Specifically, the equation for mass flow through a press is:

$$(1 - KT_n)\frac{dL_n}{dt} + L_nK\frac{dT_n}{dt} = Vn(1 - KT_n) - V_{n-1}(1 - kT_{n-1}),\ n = z, \ldots, m$$

where:

K=Young's modulus for paper

T=paper tension in a span

L=web path length in a span

V=web velocity into the span n=number of the spans

Instead of altering path length L the, speed response time of the controller is potentially improved by altering at least one of the other terms, $V_1$, $V_{n-1}$, $T_n$ and $T_{n-1}$.

We claim:

1. In a continuous web printing press having a plurality of webs, a method of controlling the relative location of page cuts of all the plurality of webs to form multiple pages having substantially equal page lengths, comprising the steps of:

placing reference marks on all of the plurality of webs;

detecting the reference marks independently of visible light from the reference marks; and controlling the relative position of page cuts of all of the plurality of webs in accordance with the light independent detecting of the reference marks on at least one of the plurality of webs through another one of the plurality of webs.

2. The method of claim 1 in which said step of controlling includes the step of operating a web path length adjuster in response to the reference marks detecting means to selectively position webs for cutting.

3. The method of claim 1 in which the step of placing includes the step of placing the reference marks on the webs by means mounted to a blanket cylinder and rotating therewith.

4. The method of claim 1 in which the step of placing includes placing magnetized magnetic material on the webs to create the reference marks, and the step of detecting includes detecting a relative magnetic field produced by the reference marks.

5. The method of claim 4 in which the step of detecting includes the step of detecting a signal from a sensor including at least one of (a) a Hall effect sensor, (b) an inductive loop sensor, and (c) a superconducting quantum interference sensor.

6. The method of claim 1 in which the step of placing includes placing material capable of being magnetized on the webs to create the reference marks.

7. The method of claim 6 including the step of magnetizing the material using at least one of (a) a permanent magnet and (b) an electromagnet.

8. The method of claim 7 in which the step of detecting includes detecting a relative magnetic field produced by the reference marks.

9. The method of claim 1 in which the step of detecting includes the step of detecting from one side of the web reference marks located on another side of the web.

10. The method of claim 1 in which the step of detecting includes the step of detecting the presence of a reference mark on the one of the plurality of webs through a body of the other one of the webs also having a reference mark.

11. The method of claim 1 in which the step of controlling includes the step of automatically adjusting the path length of the plurality of webs between the placement of the reference marks and the cutoff mechanism to maintain a preselected phase relationship between web movement and operation of the cutoff mechanism.

12. The method of claim 1 in which the step of placing includes the step of placing magnetic ink with the ink composed 30%–80% by weight of magnetic particles.

13. The method of claim 1 including the steps of threading the plurality of webs together with a threading means to form an overlapping group of webs, and sensing with a magnetic sensor the reference marks of the overlapping group of webs independently of visible light downstream of the threading means.

14. The method of claim 13 including the step of sensing with the magnetic sensor the reference marks of the overlapping group of webs upstream from the cutting mechanism by a distance less than said substantially equal page lengths.

15. In a continuous web printing press having a plurality of webs and having a cutting mechanism for making page cuts on the webs to form multiple pages having substantially equal page lengths, the improvement being a page cutting control apparatus, comprising:

means for placing reference marks on all of the plurality of webs;

means for detecting the reference marks independently of visible light from the reference marks; and means for controlling the relative position of the page cuts of all of the plurality of webs in response to the light independent detecting means detecting a reference mark on at least one of the plurality of webs through another one of the plurality of webs.

16. The continuous web printing press of claim 15 in which said controlling means includes means responsive to the reference marks detecting means for selectively positioning webs for cutting.

17. The continuous web printing press of claim 15 in which the placing means includes means for placing magnetized magnetic material on the webs to create the reference marks, and the detecting means includes means for detecting relative magnetic field disturbances of the reference marks.

18. The continuous web printing press of claim 17 in which the detecting means includes means for detecting a signal from a sensor including at least one of (a) a Hall Effect sensor, (b) an inductive loop sensor, and (c) a superconducting quantum interference detector.

19. The continuous web printing press of claim 15 in which the placing means includes means for placing material capable of being magnetized on the webs to create the reference marks.

20. The continuous web printing press of claim 19 including means for magnetizing the material using at least one of a permanent magnet and an electromagnet.

21. The continuous web printing press of claim 20 in which the detecting means includes means for detecting the relative magnetic field produced by the reference marks.

22. The continuous web printing press of claim 20 in which the detecting means includes at least one of (a) a Hall Effect sensor, (b) an inductive loop sensor, and (c) a superconducting quantum interference detector.

23. The continuous web printing press of claim 15 in which the detecting means includes means for simultaneously detecting the presence of a reference mark on the one of the webs through a body of the other one of the webs also having a reference mark.

24. The continuous web printing press of claim 15 in which the detecting means includes a single sensor for simultaneously detecting reference marks on a plurality of webs.

25. The continuous web printing press of claim 15 in which the positioning means includes means for automatically adjusting the path length of the plurality of webs between the placing means and the cutoff mechanism to maintain a preselected phase relationship between web movement and operation of the cutting mechanism.

26. The continuous web printing press of claim 15 in which the placing means includes means for placing magnetic ink at the marks with the ink composed 30%–80% by weight of magnetic particles.

27. The continuous web printing press of claim 15 in which the placing means is mounted to a blanket cylinder for rotation therewith.

28. The continuous web printing press of claim 15 in which the detecting means includes a plurality of magnetic sensors staggered apart from each other to sense the reference marks of overlapping webs independently of visible light.

29. The continuous web printing press of claim 15 in which the plurality of webs includes at least three webs such that one of the plurality of webs is sandwiched between two of the other webs.

30. The continuous web printing press of claim 15 including means for threading the plurality of webs together to form an overlapping group of webs, and a magnetic sensor located downstream of the threading means for sensing the reference marks of the overlapping group of webs independently of visible light.

31. The continuous web printing press of claim 30 in which the magnetic sensor is located upstream from the cutting mechanism by a distance less than said substantially equal page lengths.

* * * * *